US011225938B2

(12) United States Patent
Baughman

(10) Patent No.: US 11,225,938 B2
(45) Date of Patent: Jan. 18, 2022

(54) HYDRAULIC START SYSTEMS AND METHODS FOR THE SAME

(71) Applicant: OneHydraulics, Houston, TX (US)

(72) Inventor: Mark Baughman, Conroe, TX (US)

(73) Assignee: ONEHYDRAULICS, Houston, TX (US)

( * ) Notice: Subject to any disclaimer, the term of this patent is extended or adjusted under 35 U.S.C. 154(b) by 0 days.

(21) Appl. No.: 17/186,095

(22) Filed: Feb. 26, 2021

(65) Prior Publication Data

US 2021/0270220 A1 Sep. 2, 2021

Related U.S. Application Data

(60) Provisional application No. 62/983,315, filed on Feb. 28, 2020.

(51) Int. Cl.
*F02N 7/06* (2006.01)

(52) U.S. Cl.
CPC ..... *F02N 7/06* (2013.01)

(58) Field of Classification Search
CPC ..... F02N 7/06
USPC ..... 123/179.31
See application file for complete search history.

(56) References Cited

U.S. PATENT DOCUMENTS 6,460,500 B1 * 10/2002 Ooyama ..... F02N 7/00 123/179.3
8,578,713 B2 * 11/2013 Zaleski ..... F15B 21/10 60/626
9,709,046 B2 * 7/2017 Krittian ..... F02N 11/0814
2002/0166532 A1 * 11/2002 Mori ..... F02N 19/00 123/179.31
2003/0000492 A1 * 1/2003 Mori ..... F02N 7/08 123/179.31
2006/0053790 A1 * 3/2006 Foster ..... F02N 7/00 60/629
2014/0165947 A1 * 6/2014 Krittian ..... F02N 11/0803 123/179.31
2014/0208733 A1 * 7/2014 Krittian ..... F02N 7/06 60/413
2016/0084212 A1 * 3/2016 Perry ..... F04B 23/02 123/179.31

* cited by examiner

*Primary Examiner* — Phutthiwat Wongwian
*Assistant Examiner* — Arnold Castro
(74) *Attorney, Agent, or Firm* — MH2 Technology Law Group, LLP

(57) ABSTRACT

A hydraulic start system and methods for operating an engine starter with the same is disclosed. The hydraulic start system may include an accumulator and at least two pumps fluidly coupled with and disposed upstream of the accumulator. The hydraulic start system may also include a first directional valve fluidly coupled with and disposed downstream of the accumulator and upstream of the engine starter. The hydraulic start system may further include a second directional valve fluidly coupled with and disposed downstream of the accumulator and upstream of the engine starter and the first directional valve. The second directional valve may be configured to direct at least a portion of the pressurized hydraulic fluid from the accumulator to the first directional valve to actuate the first directional valve to an open position.

20 Claims, 1 Drawing Sheet

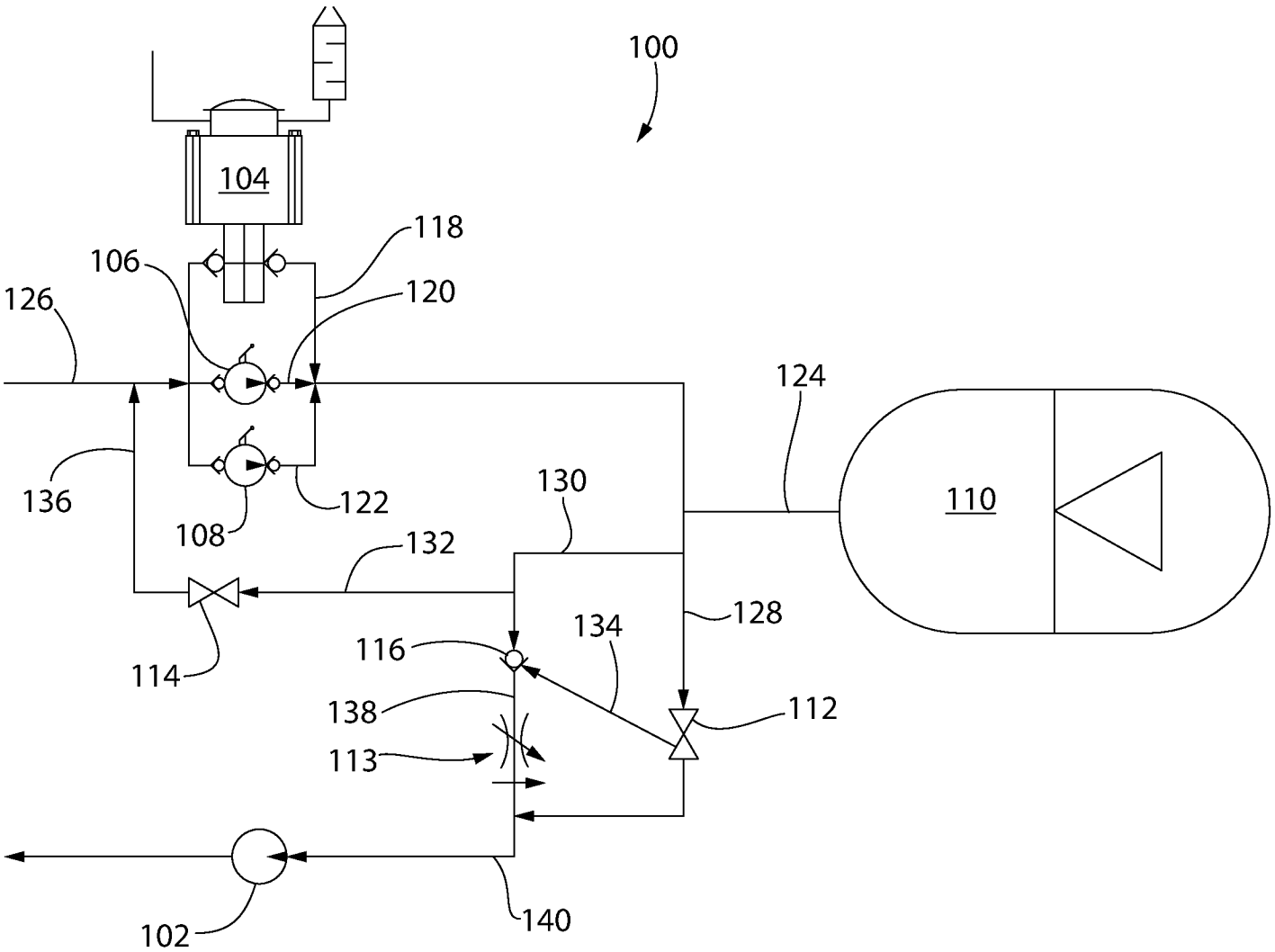
100
104
106
108
110
112
113
114
116
118
120
122
124
126
128
130
132
134
136
138
140
102

HYDRAULIC START SYSTEMS AND METHODS FOR THE SAME

CROSS-REFERENCE TO RELATED APPLICATIONS

This application claims the benefit of, and relies on the filing date of, U.S. Provisional Patent Application No. 62/983,315, filed 28 Feb. 2020, the entire disclosure of which is incorporated herein by reference.

BACKGROUND

Due to hazardous and harsh environments, diesel engines used to offload marine vessels are often started by either hydraulic or pneumatic engine start systems. Conventional hydraulic start systems are very complicated to install as they require many components. All of the components are typically coupled with one another via rubber hose assemblies and adapters. Each of the connections between the hose assemblies and adapters presents a potential leak point, which poses a risk to environmental pollution. Further, government regulations require that any hydraulic fluid (e.g., oil) that hits the deck of a vessel must be reported to regulatory agencies, which is cost prohibitive.

What is needed, then, are improved hydraulic start systems and methods for operating the same.

BRIEF SUMMARY

This summary is intended merely to introduce a simplified summary of some aspects of one or more implementations of the present disclosure. Further areas of applicability of the present disclosure will become apparent from the detailed description provided hereinafter. This summary is not an extensive overview, nor is it intended to identify key or critical elements of the present teachings, nor to delineate the scope of the disclosure. Rather, its purpose is merely to present one or more concepts in simplified form as a prelude to the detailed description below.

The foregoing and/or other aspects and utilities embodied in the present disclosure may be achieved by providing a system for operating an engine starter. The system may include at least two pumps configured to receive hydraulic fluid and pressurize the hydraulic fluid, an accumulator fluidly coupled with and disposed downstream from the at least two pumps, a first directional valve fluidly coupled with and disposed downstream of the accumulator and upstream of the engine starter, and a second directional valve fluidly coupled with and disposed downstream of the accumulator and upstream of the engine starter and the first directional valve. The accumulator may be configured to receive and store the pressurized hydraulic fluid from the at least two pumps. The first directional valve may be configured to control a flow of the pressurized hydraulic fluid from the accumulator to the engine starter. The second directional valve may be configured to direct at least a portion of the pressurized hydraulic fluid from the accumulator to the first directional valve to actuate the first directional valve to an open position.

The foregoing and/or other aspects and utilities embodied in the present disclosure may be achieved by providing a hydraulic start system for an engine starter. The hydraulic start system may include at least two pumps configured to receive hydraulic fluid and pressurize the hydraulic fluid. The at least two pumps may include an air driven pump and a hand driven pump. The hydraulic start system may include an accumulator fluidly coupled with and disposed downstream from the at least two pumps. The accumulator may be configured to receive and store the pressurized hydraulic fluid from the at least two pumps. The hydraulic start system may further include a pilot operated check valve fluidly coupled with and disposed downstream of the accumulator and upstream of the engine starter. The pilot operated check valve may be configured to control a flow of the pressurized hydraulic fluid from the accumulator to the engine starter. The hydraulic start system may further include a directional valve fluidly coupled with and disposed downstream of the accumulator and upstream of the engine starter and the pilot operated check valve. The directional valve may be configured to direct a first portion of the pressurized hydraulic fluid from the accumulator to the pilot operated check valve to actuate the pilot operated check valve to an open position. The directional valve may further be configured to direct a second portion of the pressurized hydraulic fluid from the accumulator to the engine starter. The hydraulic start system may also include a flow control valve disposed downstream of the pilot operated check valve. The flow control valve may be configured to restrict a flow of the pressurized hydraulic fluid from the pilot operated check valve to the engine starter.

The foregoing and/or other aspects and utilities embodied in the present disclosure may be achieved by providing a method for operating any one or more of the hydraulic start systems disclosed herein. The method may include pressurizing the accumulator, releasing the pressurized hydraulic fluid from the accumulator and directing the pressurized hydraulic fluid to the engine starter. The method may also include discharging the pressurized hydraulic fluid from the accumulator without directing the pressurized hydraulic fluid to the engine starter.

Further areas of applicability of the present disclosure will become apparent from the detailed description provided hereinafter. It should be understood that the detailed description and specific examples, while indicating some typical aspects of the disclosure, are intended for purposes of illustration only and are not intended to limit the scope of the disclosure.

BRIEF DESCRIPTION OF THE DRAWINGS

The accompanying drawings, which are incorporated in and constitute a part of this specification, illustrate embodiments of the present teachings. These and/or other aspects and advantages in the embodiments of the disclosure will become apparent and more readily appreciated from the following description of the various embodiments, taken in conjunction with the accompanying drawings. It is emphasized that, in accordance with the standard practice in the industry, various features are not drawn to scale. In fact, the dimensions of the various features may be arbitrarily increased or decreased for clarity of discussion.

FIG. 1 illustrates a process flow diagram of an exemplary system for operating an engine starter, according to one or more embodiments disclosed.

DETAILED DESCRIPTION

The following description of various typical aspect(s) is merely exemplary in nature and is in no way intended to limit the disclosure, its application, or uses.

As used throughout this disclosure, ranges are used as shorthand for describing each and every value that is within the range. It should be appreciated and understood that the description in a range format is merely for convenience and brevity, and should not be construed as an inflexible limitation on the scope of any embodiments or implementations disclosed herein. Accordingly, the disclosed range should be construed to have specifically disclosed all the possible subranges as well as individual numerical values within that range. As such, any value within the range may be selected as the terminus of the range. For example, description of a range such as from 1 to 5 should be considered to have specifically disclosed subranges such as from 1.5 to 3, from 1 to 4.5, from 2 to 5, from 3.1 to 5, etc., as well as individual numbers within that range, for example, 1, 2, 3, 3.2, 4, 5, etc. This applies regardless of the breadth of the range.

Additionally, all numerical values are "about" or "approximately" the indicated value, and take into account experimental error and variations that would be expected by a person having ordinary skill in the art. It should be appreciated that all numerical values and ranges disclosed herein are approximate values and ranges, whether "about" is used in conjunction therewith. It should also be appreciated that the term "about," as used herein, in conjunction with a numeral refers to a value that may be ±0.01% (inclusive), ±0.1% (inclusive), ±0.5% (inclusive), ±1% (inclusive) of that numeral, ±2% (inclusive) of that numeral, ±3% (inclusive) of that numeral, ±5% (inclusive) of that numeral, ±10% (inclusive) of that numeral, or ±15% (inclusive) of that numeral. It should further be appreciated that when a numerical range is disclosed herein, any numerical value falling within the range is also specifically disclosed.

All references cited herein are hereby incorporated by reference in their entireties. In the event of a conflict in a definition in the present disclosure and that of a cited reference, the present disclosure controls.

FIG. 1 illustrates a process flow diagram of an exemplary system or hydraulic start system 100 for operating an engine starter 102, according to one or more embodiments. The system 100 may include one or more pumps (three are shown 104, 106, 108), one or more accumulators (one is shown 110), one or more flow control valves (one is show 113), one or more directional valves (three are shown 112, 114, 116), or any combination thereof, operably and/or fluidly coupled with one another. As further described herein, the system 100 may be capable of or configured to receive a fluid or working fluid (e.g., hydraulic fluid), pressurize the fluid to a high pressure fluid, store the high pressure fluid, and subsequently release the high pressure fluid to operate the engine starter 102 operably coupled with the system 100 and thereby start an engine (not shown) operably coupled with the engine starter 102.

As discussed above, the system 100 may include one or more pumps 104, 106, 108. The one or more pumps 104, 106, 108 may be fluidly coupled with and disposed upstream of the accumulator 110. For example, as illustrated in FIG. 1, a first pump 104 may be fluidly coupled with and disposed upstream of the accumulator 110 via lines 118, 124, a second pump 106 may be fluidly coupled with and disposed upstream of the accumulator 110 via lines 120, 124, and a third pump 108 may be fluidly coupled with and disposed upstream of the accumulator 110 via lines 122, 124. The one or more pumps 104, 106, 108 may be capable of or configured to receive the fluid (e.g., hydraulic fluid) from an inlet 126, pressurize the fluid to a high pressure fluid, and deliver the high pressure fluid to the accumulator 110. It should be appreciated that the one or more pumps 104, 106, 108 may be disposed in the system 100 in parallel to provide redundancy. As such, if one or more of the pumps 104, 106, 108 become inoperable one of the remaining pumps 104, 106, 108 may be utilized to operate the system 100.

As illustrated in FIG. 1, at least one of the pumps 104, 106, 108 may be or include an air driven pump 104. The air driven pump 104 may be capable of or configured to be operated with a high pressure fluid, such as high pressure gas, from a source of high pressure fluid (not shown). For example, the air driven pump 104 may be capable of or configured to be operated with a tank of compressed gas. In at least one implementation, the air driven pump 104 may instead be a mechanically driven pump, such as a pump driven by a drill. For example, the pump 104 may be capable of or configured to be operated with a hand drill (e.g., pneumatic, electric, or battery operated hand drill).

At least one of the pumps 104, 106, 108 may be or include a hand driven pump. For example, as illustrated in FIG. 1, the second and third pumps 106, 108 may be hand driven pumps capable of or configured to be operated with a hand crank (not shown) powered by an operator (e.g., human power). In at least one implementation, each of the hand pumps 106, 108 may be simultaneously operated with a single hand crank operably coupled with both of the hand pumps 106, 108. As such, a plurality of economically cheaper hand pumps 106, 108 having relatively lower pumping capabilities may be utilized in lieu of a single more expensive hand pump having a relatively greater pumping capability.

It should be appreciated that the system 100 may be operated by any one or more of the pumps 104, 106, 108. For example, the system 100 may be operated with only the air pump 104 or only one or both of the hand pumps 106, 108. In another example, the system 100 may be operated with both the air pump 104 and at least one of the hand pumps 106, 108.

As illustrated in FIG. 1, the accumulator 110 may be fluidly coupled with and disposed downstream of the pumps 104, 106, 108 via line 124. The accumulator 110 may be capable of or configured to receive and store the high pressure fluid from the pumps 104, 106, 108. While a single accumulator 110 is illustrated in FIG. 1, it should be appreciated that any number of accumulators may be fluidly coupled with and disposed downstream of the pumps 104, 106, 108 via line 124. For example, the system 100 may include at least two, at least three, at least four, or more accumulators fluidly coupled with and disposed downstream of the pumps 104, 106, 108. Illustrative accumulators may be or include, but are not limited to, bladder accumulators, diaphragm accumulators, piston accumulators, or the like, or combinations thereof. In an exemplary implementation, at least one or all of the accumulators 110 are diaphragm accumulators. It should be appreciated that diaphragm pumps are more cost effective and the performance of a diaphragm pump in the system 100 is comparable or superior to a piston or a bladder accumulator.

The one or more directional valves 112, 114, 116 may be fluidly coupled with and disposed downstream of the accumulator 110. For example, as illustrated in FIG. 1, a first directional valve 112 may be fluidly coupled with and disposed downstream of the accumulator via lines 124, 128. In another example, illustrated in FIG. 1, a second directional valve 114 may be fluidly coupled with and disposed downstream of the accumulator 110 via lines 124, 130, 132. In yet another example, illustrated in FIG. 1, a third directional valve 116 may be fluidly coupled with and disposed downstream of the accumulator via lines 124, 130. As further illustrated in FIG. 1, at least one of the valves 112, 114, 116 may be fluidly coupled with and disposed upstream of the engine starter 102. For example, as illustrated in FIG. 1, the first and third flow control valves 112, 116 may be fluidly coupled with and disposed upstream of the engine starter 102. As further described herein, the one or more directional valves 112, 114, 116 and/or the flow control valve 113 may be capable of or configured to control a flow of the fluid flowing therethrough.

In at least one embedment, at least one of the directional valves 112, 114, 116 may be or include a two-way, two-position or two-way, two-directional valve. For example, as illustrated in FIG. 1, the first directional valve 112 may be or include a two-way, two-directional valve capable of or configured to control a flow of the fluid from the accumulator 110 to the engine starter 102. In at least one implementation, illustrated in FIG. 1, the first directional valve 112 may further be fluidly coupled with and disposed upstream of the third directional valve (e.g., a pilot operated check valve) 116 via line 134. As further described herein, the first directional valve 112 may be capable of or configured to actuate the third directional valve 116 to an open position to thereby allow a flow of the fluid therethrough from line 130 to line 138.

In at least one implementation, the second directional valve 114 may be or include a two-way, two-position valve capable of or configured to control a flow of the fluid from the accumulator 110 to an exhaust line 136. For example, the second directional valve 114 may be interposed between the accumulator 110 and the exhaust line 136 and configured to drain or relieve high pressure fluid from the accumulator 110 to the exhaust line 136.

In at least one implementation, at least one of the directional valves 112, 114, 116 may be or include a check valve. For example, as illustrated in FIG. 1, the third directional valve 116 may be a check valve that may be fluidly coupled with and disposed downstream of the accumulator 110 via lines 124, 130. In at least one implementation, the check valve may be a pilot operated check valve. The check pilot operated check valve 116 may be fluidly coupled with and disposed upstream of the engine starter 102 via lines 138, 140. The pilot operated check valve 116 may also be fluidly coupled with and disposed downstream of the first directional valve 112 via line 134.

In at least one implementation, the one or more flow control valves 113 may be or include a pressure compensated flow control valve capable of or configured to restrict or control a flow of the fluid flowing therethrough. For example, as illustrated in FIG. 1, the flow control valve 113 may be or include a pressure compensated flow control valve. As illustrated in FIG. 1, the pressure compensated flow control valve 113 may be fluidly coupled with and disposed downstream of the check valve 116 via line 138. As further illustrated in FIG. 1, the pressure compensated flow control valve 113 may be fluidly coupled with and disposed upstream of the engine starter 102 via line 140. While FIG. 1 illustrates the pressure compensated flow control valve 113 disposed downstream of the check valve 116, in at least one implementation, the pressure compensated flow control valve 113 may be fluidly coupled with and disposed downstream of both the first flow control valve 112 and the check valve 116. For example, the pressure compensated flow control valve 113 may be fluidly coupled with line 140 downstream of both the first directional valve 112 and the pilot operated check valve 116.

Methods for operating the system or the hydraulic start system 100 may include charging or pressurizing the one or more accumulators 110 with a pressurized fluid. Methods for operating the system 100 may also include storing the pressurized fluid in the accumulator 110. Methods for operating the system 100 may also include releasing the pressurized fluid from the accumulator 110 to the engine starter 102 to start an engine (not shown) operably coupled therewith. Methods for operating the system 100 may further include discharging the pressurized fluid from the accumulator 110 without directing the pressurized fluid to the engine starter 102 to allow for one or more maintenance or repair operations.

In an exemplary operation of the system or the hydraulic start system 100, with continued reference to FIG. 1, the one or more accumulators 110 may be charged with the pressurized fluid by actuating the first directional valve 112, the second directional valve 114, and the pilot operated check valve 116 to a closed position to restrict the flow of fluid therethrough. At least one of the pumps 104, 106, 108 may receive a fluid, such as a hydraulic fluid, from the inlet 126, pump and pressurize the fluid from the inlet 126, and deliver the pressurized fluid to the accumulator 110. In at least one implementation, only the first pump or the air driven pump 104 is utilized to generate the high pressure fluid and deliver the high pressure fluid to the accumulator 110. In another implementation, only one of the second or third pumps or the hand driven pumps 106, 108 is utilized to generate the high pressure fluid and deliver the high pressure fluid to the accumulator 110. In yet another implementation, at least two of the pumps 104, 106, 108 are utilized to generate the high pressure fluid and deliver the high pressure fluid to the accumulator 110. For example, the two hand driven pumps 106, 108 may be utilized simultaneously to generate the high pressure fluid and deliver the high pressure fluid to the accumulator 110. In another example, at least one of the hand driven pumps 106, 108 may be operated with the air driven pump 104 to generate the high pressure fluid and deliver the high pressure fluid to the accumulator 110. In at least one implementation, illustrated in FIG. 1, each of the pumps 104, 106, 108 may be interposed between two check valves to prevent a backflow of the pressurized fluid upstream towards the inlet 126.

The one or more accumulators 110 may receive the high pressure fluid from the one or more pumps 104, 106, 108 and store the pressurized fluid therein. The pressurized fluid stored in the accumulator 110 may at least partially maintain the check valve 116 in a closed position.

As discussed above, the method for operating the system 100 may include releasing the pressurized fluid from the accumulator 110 to the engine starter 102 to start the engine operably coupled therewith. To release the pressurized fluid from the accumulator 110, the first directional valve 112 may be actuated to an open position to thereby allow a flow of the high pressure fluid from the accumulator 110 to the engine starter 102 via line 140. The flow of the high pressure fluid from the accumulator 110 to the engine starter 102 via the directional valve 112 and line 140 may at least partially operate the engine starter 102. For example, the flow of the high pressure fluid from the first flow control valve 112 to the engine starter 102 may at least cause a gear (not shown) and a fly wheel (not shown) of the engine to contact one another to thereby "soft start" the engine starter 102.

The actuation of the first flow control valve 112 to the open position may also allow a flow of the high pressure fluid from the accumulator 110 to the pilot operated check valve 116 via the first directional valve 112 and line 134. The flow of the high pressure fluid from the first directional valve 112 to the pilot operated check valve 116 may actuate the pilot operated check valve 116 to an open position to thereby allow a flow of the high pressure fluid from the accumulator 110 to the engine starter 102 via lines 124, 130, the check valve 116, the pressure compensated flow control valve 113, and line 140. As illustrated in FIG. 1, the high pressure fluid from the check valve 116 may be directed to the engine starter 102 via the pressure compensated flow control valve 113 and line 140. The pressurized compensated flow control valve 113 may at least partially control or restrict a flow of the pressurized fluid directed to the engine starter 102.

It should be appreciated that a relatively greater amount of flow (e.g., flow rate) or volume of the high pressure fluid from the accumulator 110 may be provided through the pilot operated check valve 116 than the first directional valve 112. Said in another way, during one or more modes of operating the system 100 (e.g., starting the engine starter 102), the flow through the check valve 116 may be relatively greater than the flow through the first directional valve 112. As such, it should be appreciated that the engine starter 102 is generally operated by the actuation of the pilot operated check valve 116, and the first flow control valve 112 may only provide a flow of the high pressure fluid sufficient to "soft start" the engine starter 102. In at least one implementation, during operation of starting the engine starter 102, the flow through the first flow control valve 112 may be from about 1 gpm to about 8 gpm, the flow through the check valve 116 may be from about 13 gpm to about 30 gpm, and the flow through the pressure compensated flow control valve 113 may be from about 13 gpm to about 30 gpm.

As discussed above, the method for operating the system 100 may further include discharging or draining the pressurized fluid from the accumulator 110 without directing the pressurized fluid to the engine starter 102 to allow for one or more maintenance or repair operations. To discharge the pressurized fluid from the accumulator 110 without operating or directing the pressurized fluid to the engine starter 102, the second directional valve 114 may be actuated to an open position, thereby allowing the high pressure fluid stored in the accumulator 110 to vent to the exhaust line 136 via lines 124, 130, 132.

In at least one implementation, the system 100 may include an enclosure (not shown) capable of or configured to contain or house the one or more components of the system 100. The enclosure may be or include any vessel, container, or enclosure sufficiently sized and/or shaped to contain the one or more components of the system 100. The enclosure may also be capable of or configured to store any fluids (e.g., hydraulic fluid) that may leak from the system 100, thereby preventing any fluids from contacting a deck of a vessel or the environment in which the system 100 is operating. It should be appreciated that the ability to contain any leaks in the enclosure may allow the operator to avoid any environmental impact from the leakage. It should further be appreciated that the ability to contain any leaks in the enclosure may allow the system 100 to avoid triggering any events that may require reporting of the leak to a regulatory agency.

In at least one implementation, a cover (not shown) of the enclosure may be operably coupled with the second directional valve 114 such that the cover of the enclosure may not be removed without actuating the third flow control valve 114 to the opened position. For example, removal of the cover may be hindered until the second directional valve 114 is actuated to the opened position. It should be appreciated that operably coupling the cover of the enclosure with the second directional valve 114 may allow the system 100 or the accumulator 110 thereof to be safely exhausted prior to providing access to any one or more components of the system 100 for maintenance and/or repair operations.

In at least one embodiment, any one or more lines disclosed herein may be provided by a continuous line without couplers and/or joints. For example, lines 126, 140 may be provided by a single, continuous tubing to reduce the number of couplers and/or joints, thereby reducing potential points for leakage. It should be appreciated, however, that any two or more of the lines disclosed herein may be provided by a single, continuous line or tubing to reduce the number of couplers and/or joints.

The present disclosure has been described with reference to exemplary implementations. Although a limited number of implementations have been shown and described, it will be appreciated by those skilled in the art that changes may be made in these implementations without departing from the principles and spirit of the preceding detailed description. It is intended that the present disclosure be construed as including all such modifications and alterations insofar as they come within the scope of the appended claims or the equivalents thereof.

What is claimed is:

1. A system for operating an engine starter, comprising:
at least two pumps configured to receive hydraulic fluid and pressurize the hydraulic fluid;
an accumulator fluidly coupled with and disposed downstream from the at least two pumps, the accumulator being configured to receive and store the pressurized hydraulic fluid from the at least two pumps;
a first directional valve fluidly coupled with and disposed downstream of the accumulator and upstream of the engine starter, the first directional valve configured to control a flow of the pressurized hydraulic fluid from the accumulator to the engine starter; and
a second directional valve fluidly coupled with and disposed downstream of the accumulator and upstream of the engine starter and the first directional valve, the second directional valve configured to direct at least a portion of the pressurized hydraulic fluid from the accumulator to the first directional valve to actuate the first directional valve to an open position.

2. The system of claim 1, wherein a first pump of the at least two pumps is an air driven pump.

3. The system of claim 2, wherein a second pump of the at least two pumps is a hand driven pump, the system further comprising a second hand driven pump fluidly coupled with and disposed upstream of the accumulator.

4. The system of claim 1, further comprising a flow control valve disposed downstream of the first directional valve, the flow control valve configured to restrict a flow of the pressurized hydraulic fluid from the first directional valve to the engine starter, wherein the flow control valve is disposed downstream of the first directional valve and the second directional valve.

5. The system of claim 1, further comprising a third directional valve fluidly coupled with and disposed downstream of the accumulator, the third directional valve configured to direct the pressurized hydraulic fluid from the accumulator to an exhaust line.

6. The system of claim 1, wherein a flow through the first directional valve is relatively greater than a flow through the second directional valve.

7. The system of claim 1, wherein the accumulator is a diaphragm accumulator.

8. The system of claim 1, further comprising an enclosure configured to contain the at least two pumps, the accumulator, the first directional valve, and the second directional valve.

9. A hydraulic start system for an engine starter, comprising:

at least two pumps configured to receive hydraulic fluid and pressurize the hydraulic fluid, wherein the at least two pumps comprise an air driven pump and a hand driven pump;

an accumulator fluidly coupled with and disposed downstream from the at least two pumps, the accumulator being configured to receive and store the pressurized hydraulic fluid from the at least two pumps;

a pilot operated check valve fluidly coupled with and disposed downstream of the accumulator and upstream of the engine starter, the pilot operated check valve configured to control a flow of the pressurized hydraulic fluid from the accumulator to the engine starter;

a directional valve fluidly coupled with and disposed downstream of the accumulator and upstream of the engine starter and the pilot operated check valve, wherein the directional valve is configured to direct a first portion of the pressurized hydraulic fluid from the accumulator to the pilot operated check valve to actuate the pilot operated check valve to an open position, and wherein the directional valve is further configured to direct a second portion of the pressurized hydraulic fluid from the accumulator to the engine starter; and a flow control valve disposed downstream of the pilot operated check valve, the flow control valve configured to restrict a flow of the pressurized hydraulic fluid from the pilot operated check valve to the engine starter.

10. The hydraulic start system of claim 9, wherein the at least two pumps further comprise a second hand driven pump fluidly coupled with and disposed upstream of the accumulator.

11. The hydraulic system of claim 10, wherein the air driven pump, the hand driven pump, and the second hand driven pump are disposed in parallel with one another.

12. The hydraulic start system of claim 9, wherein the flow control valve is disposed downstream of the pilot operated check valve and the directional valve.

13. The hydraulic start system of claim 9, further comprising a second directional valve fluidly coupled with and disposed downstream of the accumulator, the second directional valve configured to direct the pressurized hydraulic fluid from the accumulator to an exhaust line.

14. The hydraulic start system of claim 9, wherein a flow through the pilot operated check valve is relatively greater than a flow through the directional valve.

15. The hydraulic start system of claim 9, further comprising an enclosure configured to contain the at least two pumps, the accumulator, the pilot operated check valve, the directional valve, and the flow control valve, and further configured to prevent leakage of the hydraulic fluid from the hydraulic start system.

16. A method for operating the hydraulic start system of claim 9, the method comprising:

pressurizing the accumulator; and releasing the pressurized hydraulic fluid from the accumulator and directing the pressurized hydraulic fluid to the engine starter.

17. The method of claim 16, wherein pressurizing the accumulator comprises pressurizing the accumulator with the hand driven pump, the air driven pump, or a combination thereof, and wherein pressurizing the accumulator comprises actuating the pilot operated check valve and the directional valve to a closed position.

18. The method of claim 16, wherein releasing the pressurized hydraulic fluid from the accumulator and directing the pressurized hydraulic fluid to the engine starter comprises actuating the directional valve to an open position.

19. The method of claim 18, wherein releasing the pressurized hydraulic fluid from the accumulator and directing the pressurized hydraulic fluid to the engine starter further comprises directing a portion of the pressurized fluid from the directional valve to the pilot operated check valve to actuate the pilot operated check valve to an open position.

20. The method of claim 16, further comprising discharging the pressurized hydraulic fluid from the accumulator without directing the pressurized hydraulic fluid to the engine starter.

* * * * *